US008739881B2

(12) United States Patent
Frazier

(10) Patent No.: US 8,739,881 B2
(45) Date of Patent: Jun. 3, 2014

(54) HYDROSTATIC FLAPPER STIMULATION VALVE AND METHOD

(76) Inventor: W. Lynn Frazier, Corpus Christi, TX (US)

( * ) Notice: Subject to any disclaimer, the term of this patent is extended or adjusted under 35 U.S.C. 154(b) by 399 days.

(21) Appl. No.: 12/907,701

(22) Filed: Oct. 19, 2010

(65) Prior Publication Data

US 2011/0155380 A1 Jun. 30, 2011

Related U.S. Application Data

(63) Continuation-in-part of application No. 12/732,345, filed on Mar. 26, 2010, now abandoned.

(60) Provisional application No. 61/291,216, filed on Dec. 30, 2009.

(51) Int. Cl.

| | |
|---|---|
| ***E21B 34/06*** | (2006.01) |
| ***E21B 34/10*** | (2006.01) |
| ***E21B 34/14*** | (2006.01) |

(52) U.S. Cl.

USPC ..... 166/332.8; 166/323; 166/325

(58) Field of Classification Search

USPC ..... 166/332.8, 323, 325; 137/527

See application file for complete search history.

(56) References Cited

U.S. PATENT DOCUMENTS

| | | | |
|---|---|---|---|
| 244,042 | A | 7/1881 | Farrar |
| 2,368,428 | A | 1/1945 | Saurenman |
| 2,565,731 | A | 8/1951 | Johnston |
| 2,874,927 | A | 2/1954 | Conrad |
| 2,756,828 | A | 7/1956 | Deily |
| 2,853,265 | A | 9/1958 | Clark, Jr. |
| 3,015,469 | A | 1/1962 | Falk |
| 3,159,217 | A | 12/1964 | Hanson |
| 3,275,080 | A | 9/1966 | Nelson et al. |
| 3,289,762 | A | 12/1966 | Schell et al. |
| 3,289,769 | A | 12/1966 | Nelson et al. |
| 3,292,707 | A | 12/1966 | Nelson et al. |
| 3,526,278 | A | 9/1970 | Scott |
| 3,606,923 | A | 9/1971 | Berryman |
| 3,980,134 | A | 9/1976 | Amancharla |
| 3,995,692 | A | 12/1976 | Seitz |
| 4,122,898 | A | 10/1978 | Nelson |

(Continued)

FOREIGN PATENT DOCUMENTS

| | | |
|---|---|---|
| GB | 1423293 | 2/1976 |

OTHER PUBLICATIONS http://www.glossary.oilfield.slb.com/DisplayImage.cfm?ID=636, Schlumberger, Mar. 2006.

*Primary Examiner* — Giovanna Wright
(74) *Attorney, Agent, or Firm* — Edmonds & Nolte, P.C.

(57) ABSTRACT

A downhole tool and system are provided. In at least one specific embodiment, the downhole tool can include a tubular housing having an inner bore and a valve seat. A sleeve can be disposed in the inner bore and can be configured to move between a first position and a second position within the tubular housing. A flapper valve can be coupled to the tubular housing, such that the flapper valve is stationary when the sleeve is in the first position. The flapper valve can be pivotable between an open position and a closed position when the sleeve is in the second position. A biasing member can be coupled to the flapper valve and to the tubular housing. The biasing member can be configured to bias the flapper valve toward the valve seat.

20 Claims, 6 Drawing Sheets

(56) References Cited

U.S. PATENT DOCUMENTS

| | | | | |
|---|---|---|---|---|
| 4,134,455 | A | 1/1979 | Read | |
| 4,218,299 | A | 8/1980 | Lindell et al. | |
| 4,349,071 | A | 9/1982 | Fish | |
| 4,391,337 | A | 7/1983 | Ford et al. | |
| 4,427,071 | A | 1/1984 | Carmody | |
| 4,433,702 | A | 2/1984 | Baker | |
| 4,444,266 | A | 4/1984 | Pringle | |
| 4,457,376 | A | 7/1984 | Carmody et al. | |
| 4,478,286 | A | 10/1984 | Fineberg | |
| 4,510,994 | A | 4/1985 | Pringle | |
| 4,531,587 | A | 7/1985 | Fineberg | |
| 4,541,484 | A | 9/1985 | Salerni et al. | |
| 4,553,559 | A | 11/1985 | Short, III | |
| 4,583,596 | A | 4/1986 | Davis | |
| 4,605,074 | A | 8/1986 | Barfield | |
| 4,637,468 | A | 1/1987 | Derrick | |
| 4,687,063 | A | 8/1987 | Gilbert | |
| 4,691,775 | A | 9/1987 | Lustig et al. | |
| 4,694,903 | A | 9/1987 | Ringgenberg | |
| 4,739,799 | A | 4/1988 | Carney et al. | |
| 4,813,481 | A | 3/1989 | Sproul et al. | |
| 4,969,524 | A | 11/1990 | Whiteley | |
| 5,012,867 | A | 5/1991 | Kilgore | |
| 5,056,595 | A | 10/1991 | Desbrandes | |
| 5,137,090 | A | 8/1992 | Hare et al. | |
| 5,156,207 | A | 10/1992 | Haugen et al. | |
| 5,188,182 | A | 2/1993 | Echols, III et al. | |
| 5,224,540 | A | 7/1993 | Streich et al. | |
| 5,271,468 | A | 12/1993 | Streich et al. | |
| 5,281,270 | A | 1/1994 | Totten et al. | |
| 5,310,005 | A | 5/1994 | Dollison | |
| 5,390,737 | A | 2/1995 | Jacobi et al. | |
| 5,479,986 | A | 1/1996 | Gano et al. | |
| 5,511,617 | A | 4/1996 | Snider et al. | |
| 5,564,502 | A | 10/1996 | Crow et al. | |
| 5,607,017 | A | 3/1997 | Owens et al. | |
| 5,685,372 | A | 11/1997 | Gano | |
| 5,701,959 | A | 12/1997 | Hushbeck et al. | |
| 5,765,641 | A | 6/1998 | Shy et al. | |
| 5,839,515 | A | 11/1998 | Yuan et al. | |
| 5,862,864 | A | 1/1999 | Whiteford | |
| 5,924,696 | A | 7/1999 | Frazier | |
| 5,984,007 | A | 11/1999 | Yuan et al. | |
| 6,076,600 | A | 6/2000 | Vick, Jr. et al. | |
| 6,098,716 | A | 8/2000 | Hromas et al. | |
| 6,167,957 | B1 | 1/2001 | Frazier | |
| 6,196,261 | B1 | 3/2001 | Dennistoun | |
| 6,220,349 | B1 | 4/2001 | Vargus et al. | |
| 6,220,350 | B1 | 4/2001 | Brothers et al. | |
| 6,227,299 | B1 | 5/2001 | Dennistoun | |
| 6,289,926 | B1 | 9/2001 | Dennistoun | |
| 6,296,061 | B1 | 10/2001 | Leismer | |
| 6,328,109 | B1 | 12/2001 | Pringle et al. | |
| 6,328,112 | B1 | 12/2001 | Malone | |
| 6,354,374 | B1 | 3/2002 | Edwards et al. | |
| 6,386,288 | B1 | 5/2002 | Snider et al. | |
| 6,394,187 | B1 * | 5/2002 | Dickson et al. | 166/383 |
| 6,478,091 | B1 | 11/2002 | Gano | |
| 6,536,524 | B1 | 3/2003 | Snider | |
| 6,543,538 | B2 | 4/2003 | Tolman et al. | |
| 6,575,249 | B2 | 6/2003 | Deaton | |
| 6,662,874 | B2 * | 12/2003 | Surjaatmadja et al. | 166/308.6 |
| 6,666,271 | B2 | 12/2003 | Deaton et al. | |
| 6,684,950 | B2 | 2/2004 | Patel | |
| 6,712,145 | B2 | 3/2004 | Allamon | |
| 6,732,803 | B2 | 5/2004 | Garcia et al. | |
| 6,742,584 | B1 | 6/2004 | Appleton | |
| 6,761,219 | B2 | 7/2004 | Snider et al. | |
| 6,808,020 | B2 | 10/2004 | Garcia et al. | |
| 6,851,477 | B2 | 2/2005 | Hill, Jr. et al. | |
| 6,959,763 | B2 | 11/2005 | Hook et al. | |
| 6,959,766 | B2 | 11/2005 | Connell | |
| 6,966,378 | B2 | 11/2005 | Hromas et al. | |
| 7,044,241 | B2 | 5/2006 | Angman | |
| 7,063,156 | B2 | 6/2006 | Patel et al. | |
| 7,067,445 | B2 | 6/2006 | Webber et al. | |
| 7,073,589 | B2 | 7/2006 | Tiernan et al. | |
| 7,086,480 | B2 | 8/2006 | Simpson et al. | |
| 7,086,481 | B2 | 8/2006 | Hosie et al. | |
| 7,140,443 | B2 | 11/2006 | Beierbach et al. | |
| 7,168,494 | B2 | 1/2007 | Starr et al. | |
| 7,213,653 | B2 | 5/2007 | Vick, Jr. | |
| 7,246,668 | B2 | 7/2007 | Smith | |
| 7,252,153 | B2 | 8/2007 | Hejl et al. | |
| 7,255,178 | B2 | 8/2007 | Slup et al. | |
| 7,273,099 | B2 | 9/2007 | East, Jr. et al. | |
| 7,287,596 | B2 | 10/2007 | Frazier et al. | |
| 7,325,616 | B2 | 2/2008 | Lopez de Cardenas et al. | |
| 7,350,582 | B2 | 4/2008 | McKeachnie et al. | |
| 7,357,181 | B2 * | 4/2008 | Webb et al. | 166/285 |
| 7,387,165 | B2 | 6/2008 | Lopez de Cardenas et al. | |
| 7,451,815 | B2 | 11/2008 | Hailey, Jr. | |
| 7,513,311 | B2 | 4/2009 | Gramstad et al. | |
| 7,537,062 | B2 | 5/2009 | Hughes | |
| 7,624,809 | B2 | 12/2009 | Frazier et al. | |
| 7,665,528 | B2 | 2/2010 | Ross et al. | |
| 7,708,066 | B2 | 5/2010 | Frazier | |
| 7,798,235 | B2 * | 9/2010 | Mondelli et al. | 166/373 |
| 2002/0125011 | A1 | 9/2002 | Snider | |
| 2002/0162662 | A1 | 11/2002 | Passamaneck et al. | |
| 2003/0047315 | A1 | 3/2003 | Allamon | |
| 2003/0155112 | A1 | 8/2003 | Tiernan et al. | |
| 2005/0087335 | A1 | 4/2005 | Vick, Jr. | |
| 2006/0048936 | A1 | 3/2006 | Fripp et al. | |
| 2006/0070744 | A1 | 4/2006 | Smith | |
| 2006/0124310 | A1 | 6/2006 | Lopez de Cardenas et al. | |
| 2006/0124311 | A1 * | 6/2006 | Lopez de Cardenas et al. | 166/313 |
| 2006/0124315 | A1 | 6/2006 | Frazier et al. | |
| 2007/0074873 | A1 | 4/2007 | McKeachnie et al. | |
| 2008/0011487 | A1 | 1/2008 | Bertane et al. | |
| 2008/0023205 | A1 * | 1/2008 | Craster et al. | 166/387 |
| 2008/0035353 | A1 * | 2/2008 | Hughes et al. | 166/386 |
| 2008/0047717 | A1 | 2/2008 | Frazier et al. | |
| 2008/0078553 | A1 * | 4/2008 | George | 166/332.8 |
| 2008/0149345 | A1 * | 6/2008 | Marya et al. | 166/376 |
| 2009/0056951 | A1 | 3/2009 | Mosher et al. | |
| 2009/0159274 | A1 | 6/2009 | Frazier | |
| 2009/0242206 | A1 | 10/2009 | Goughnour et al. | |
| 2011/0155392 | A1 * | 6/2011 | Frazier | 166/373 |

* cited by examiner

HYDROSTATIC FLAPPER STIMULATION VALVE AND METHOD

CROSS-REFERENCE TO RELATED APPLICATIONS

This application is a continuation-in-part (CIP) of co-pending U.S. patent application having Ser. No. 12/732,345, filed on Mar. 26, 2010, which claims the benefit of U.S. Provisional Patent Application having Ser. No. 61/291,216, filed on Dec. 30, 2009, which are both incorporated by reference herein.

BACKGROUND

1. Field of the Invention

Embodiments of the present invention generally relate to isolation valves in wellbore completions. More particularly, embodiments of the present invention relate to flapper valves for isolating one casing region from another.

2. Description of the Related Art

Fracturing techniques in wellbores have been used to extract fluids, such as hydrocarbons like natural gas, from wellbores that would otherwise be unproductive. In situations where multiple hydrocarbon-bearing zones are encountered in vertical wells, horizontal wells, or in deviated wells, the multiple zones can be fractured one after another. This can be accomplished by perforating and then fracturing a distal zone and placing a bridge plug in the casing immediately above the fractured distal zone. This can isolate the fractured distal zone, allowing an adjacent proximal zone to be perforated and fractured. This process can be repeated until all of the desired zones have been fractured.

Once all the desired zones have been fractured, the bridge plugs between adjacent zones can be destroyed or opened to allow fluids from the fractured zones to flow in a commingled stream up the tube string to the surface. To accomplish this, the plugs can be broken apart or drilled out to allow the flow of fluid; however, this can leave fouling debris in the tube string and can present difficulties especially in deviated wells. Some plugs can instead be dissolved using activating agents, but this can limit the fluids that can be used with the downhole tool or present challenges if other dissolvable elements are used in the wellbore that are not intended to dissolve at the same time as the plug. The plugs can also be check valves, such as flapper valves, but the check valves need to be maintained in the open position during deployment down the well and thus require manipulation to allow them to operate at the desired time. This manipulation can require expensive equipment and can delay the sequential fracturing process. What is needed is a bridge plug that can effectively isolate the multiple zones, which can be deployed and removed without suffering from the drawbacks described above or others.

SUMMARY

A downhole tool and system are provided. In at least one specific embodiment, the downhole tool can include a tubular housing having an inner bore and a valve seat. A sleeve can be disposed in the inner bore and can be configured to move between a first position and a second position within the tubular housing. A flapper valve can be coupled to the tubular housing, such that the flapper valve is stationary when the sleeve is in the first position. The flapper valve can be pivotable between an open position and a closed position when the sleeve is in the second position. A biasing member can be coupled to the flapper valve and to the tubular housing. The biasing member can be configured to bias the flapper valve toward the valve seat.

In at least one specific embodiment, a flapper valve assembly can include a tubular housing connectable to a wellbore casing string. The tubular housing can have a storage cavity defined therein and can include a valve seat. The flapper valve assembly can also include a sleeve moveable between a first position and a second position. The sleeve in the first position can cover the storage cavity and the sleeve in the second position can at least partially uncover the storage cavity. A flapper valve can be disposed in the tubular housing. The flapper valve can be contained in the storage cavity when the sleeve is in the first position, and the flapper valve can be pivotable between an open position and a closed position when the sleeve is in the second position. A first biasing member can engage the tubular housing and the flapper valve, and a second biasing member can pivotally couple the flapper valve to the tubular housing. The first biasing member and the second biasing member can be configured to bias the flapper valve toward the valve seat. A pressurized chamber can be in fluid communication with the sleeve and can be adapted to apply a hydrostatic force on the sleeve such that the sleeve moves longitudinally from the first position to the second position.

In at least one specific embodiment, a completion for a wellbore can include a casing string having one or more segments. One or more isolation devices can be coupled to one or more of the casing string segments. One or more flapper valve assemblies can be coupled to one or more of the casing string segments. The flapper valve assembly can include a tubular housing connectable to a wellbore casing string. The tubular housing can have an inner bore and a valve seat. The flapper valve assembly can also include a sleeve disposed in the inner bore and configured to move between a first position and a second position within the tubular housing. A flapper valve can be disposed in the tubular housing. The flapper valve can be stationary when the sleeve is in the first position, and the flapper valve can be pivotable between an open position and a closed position when the sleeve is in the second position. A biasing members can be coupled to the flapper valve and to the tubular housing. The biasing member can be configured to bias the flapper valve toward the valve seat. A pressurized chamber can be disposed within the inner bore of the tubular in fluid communication with the sleeve and can be adapted to apply a hydrostatic force on the sleeve upon activation of the downhole tool to move the sleeve from the first position to the second position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this disclosure is combined with available information and technology.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same can be equally effective in either horizontal or vertical wellbore uses.

Figure 1:
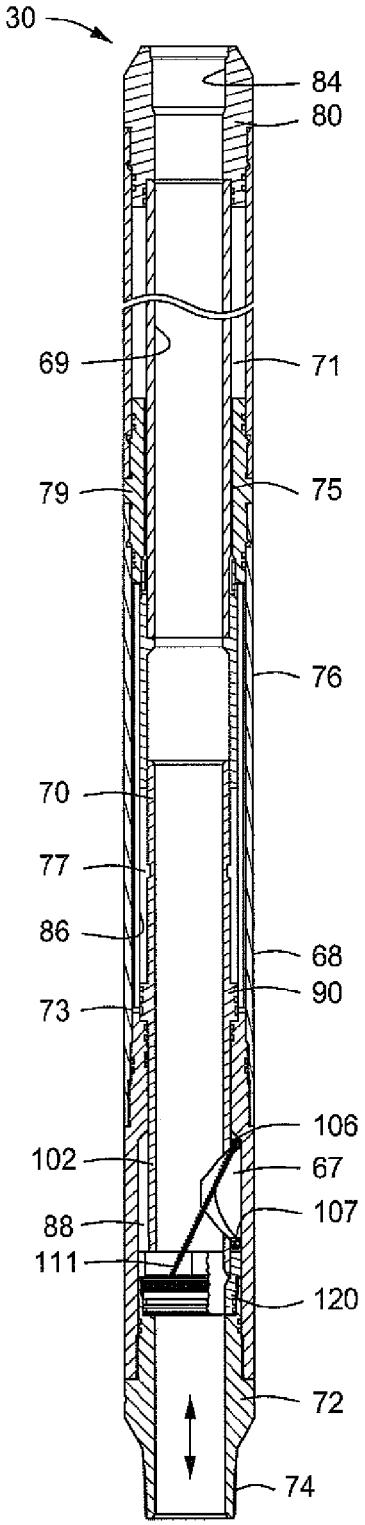
FIG. 1 depicts a cross-sectional view of an illustrative flapper valve assembly, showing an illustrative flapper valve in a stowed position, according to one or more embodiments described.
Figure 2:
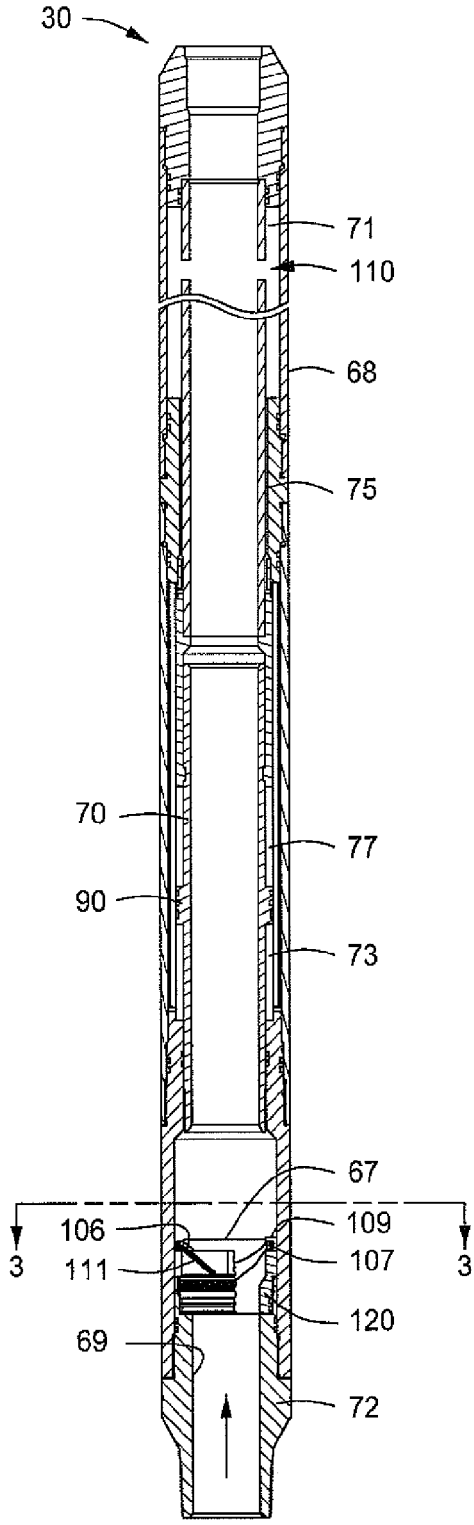
FIG. 2 depicts a view similar to FIG. 1, showing the illustrative flapper valve blocking a downward flow of fluid into a well, according to one or more embodiments described.

FIGS. 1 and 2 depict an illustrative flapper valve assembly 30 that can connect to a casing string as part of a wellbore completion (not shown), according to one or more embodiments. The flapper valve assembly 30 can have a flapper valve 67, a sleeve 70, and a pressurized chamber 71. The sleeve 70 can be slidable or otherwise moveable between a first position, shown in FIG. 1, and a second position, shown in FIG. 2. The pressurized chamber 71 can enable the movement of the sleeve 70 by hydrostatic force, without requiring mechanical manipulation of the sleeve 70.

In the first position, the sleeve 70 can store, maintain, "stow," or otherwise contain the flapper valve 67 in an inoperative state or completely open position, which can also be referred to herein as a "stowed" position. The flapper valve 67 can be stationary when stowed, for example, during deployment of the casing string to which the flapper valve assembly 30 can be attached. In the second position, the sleeve 30 can release the flapper valve 67 into an operative or functional state, allowing the flapper valve 67 to be able to block a flow of fluid in at least one direction. The flapper valve 67 either can be stowed or can be in the operative state. When stowed, the flapper valve 67 is always in an open position, as shown in FIG. 1. In the operative state, the flapper valve 67 can be in a closed position as shown, or in a range of open positions.

The flapper valve assembly 30 can also include a tubular housing 68, which can have an inner bore 69 and a lower sub 72. The lower sub 72 can have a threaded lower end 74 that can match the threads of any pipe joints or collars that can be included in a wellbore completion along with the flapper valve assembly 30. The tubular housing 68 can also have a central sub 76 coupled to the lower sub 72 and to an upper sub 80, for example, using threaded connections. The upper sub 80 can be threaded onto the central sub 76 using a connecting member 79 and can provide a threaded end 84 that can attach to the casing string (not shown). The upper sub 80 can also include a smooth-walled portion 86 of the inner bore 69. The sleeve 70 can include a piston 90 connected thereto or integrally formed therewith. The piston 90 can include one or more O-rings and/or other sealing devices to create slidable and sealing engagement between the piston 90 and the smooth-walled portion 86 of the tubular housing 68.

The tubular housing 68 can include a valve seat 120. The valve seat 120 can be a separate cylinder that is coupled, for example, sealingly coupled, to the lower and/or upper subs 72, 80. The valve seat 120 can have a frusto-conical portion in the inner bore 69. For example, the frusta-conical portion of the valve seat 120 can narrow the diameter of the inner bore 69 between the upper sub 80 and the lower sub 72. The valve seat 120 can also be integral with the lower sub 72, upper sub 80, or another portion of the tubular housing 68 (not shown), such that the valve seat 120 is provided thereby. Accordingly, when other components are described herein as coupling to the tubular housing 68, it will be appreciated that, when appropriate, they can be coupled to the valve seat 120.

The sleeve 70 can include a lower section 102 that can have a smaller external diameter than the tubular housing 68 and can thereby provide a storage cavity 88 for the flapper valve 67 radially between the sleeve 70 and the tubular housing 68. In the first position, the lower section 102 of the sleeve 70 can engage the valve seat 120, as shown in FIG. 1, or the lower sub 72 (not shown) and can thereby seal against the valve seat 120 or the lower sub 72 so that any materials proceeding through the inner bore 69 can be prevented from entering the storage cavity 88 and interfering with operation of the flapper valve 67. For example, the lower section 102 of the sleeve 70 can engage the frusto-conical portion of the valve seat 120. The sleeve 70 can have an inner diameter that can be substantially the same as a diameter of the inner bore 69 proximal the upper sub 80 and/or lower sub 72, as shown.

As shown in FIGS. 1 and 2, the flapper valve 67 can be pivotally coupled to the tubular housing 68 and/or the valve seat 120 with one or more bands or first biasing members 111 and/or one or more second biasing members 109. The biasing members 109, 111 can urge the flapper valve 67 toward a closed position, as illustrated in FIG. 2. The first biasing member 111 can be or include one or more tension springs as shown, one or more elastic bands, or any other elongate structure having elastic properties. The second biasing member 109 can be or include a pivot pin-and-spring assembly. The biasing members 109, 111 can include additional pivot pin-and-spring assemblies or the like and/or additional tension springs. Furthermore, the biasing members 109, 111 can be or include any other or additional biasing structures or configurations.

The biasing members 109, 111 can be made from any suitable material. Such suitable materials include but are not limited to any one or more metals (such as aluminum, steel, stainless steel, brass, nickel), fiberglass, wood, composite materials (such as ceramics, wood/polymer blends, cloth/polymer blends, etc.), and plastics (such as polyethylene, polyethylene (UHMW), polypropylene, polystyrene, polyurethane, polyethylethylketone (PEEK), polytetrafluoroethylene (PTFE), polyamide resins (such as nylon 6 (N6), nylon 66 (N66)), polyester resins (such as polybutylene terephthalate (PBT), polyethylene terephthalate (PET), polyethylene isophthalate (PEI), PET/PEI copolymer) polynitrile resins (such as polyacrylonitrile (PAN), polymethacrylonitrile, acrylonitrile-styrene copolymers (AS), methacrylonitrile-styrene copolymers, methacrylonitrile-styrene-butadiene copolymers; and acrylonitrile-butadiene-styrene (ABS)), polymethacrylate resins (such as polymethyl methacrylate and polyethylacrylate), cellulose resins (such as cellulose acetate and cellulose acetate butyrate); polyimide resins (such as aromatic polyimides), polycarbonates (PC), elastomers (such as ethylene-propylene rubber (EPR), ethylene propylene-diene monomer rubber (EPDM), styrenic block copolymers (SBC), polyisobutylene (PIB), butyl rubber, neoprene rubber, halobutyl rubber and the like), as well as mixtures, blends, and copolymers of any and all of the foregoing materials.

The first biasing member 111 can be coupled to a first or distal end 106 of the flapper valve 67 and the valve seat 120, and the second biasing member 109 can be coupled to a second or proximal end 107 of the flapper valve 67 and to the valve seat 120. As used herein, "proximal" refers to next to or nearest the point of attachment of the flapper valve 67 to the valve seat 120 and "distal" refers to a point situated farthest from the point of attachment of the flapper valve 67 to the valve seat 120. For example, the first end 106 and the second end 107 can be substantially opposed.

The biasing members 109, 111 can urge the flapper valve 67 toward the lower sub 72 (counterclockwise, as shown in FIGS. 1 and 2) and, specifically, toward the valve seat 120. When the sleeve 70 slides to the second position, for example, the biasing members 109, 111 can assist movement of the flapper valve 67 toward the valve seat 120 and into the closed position. For example, the first biasing member 111 can be stretched from its natural position when the flapper valve 67 is stowed behind the sleeve 70. Accordingly, the tension and/or contracting force of the first biasing member 111 can urge the first end 106 of the flapper valve 67 towards the valve seat 120 and/or the lower sub 72 when the flapper valve 67 is released from the stowed position to the operative state. The second biasing member 109 can also apply a force to the second end 107 of the flapper valve 67.

As depicted in FIG. 2, the flapper valve 67 can be in the closed position when, for example, the force applied on the flapper valve 67 by the pressure from above plus the biasing force of the first biasing member 111 and/or the second biasing member 109 is greater than the force applied on the flapper valve 67 from below.

The flapper valve 67 can have a concave or saddle-shaped upper and/or lower face, such that, for example, a cross-section of the flapper valve 67 can be arcuate. When the flapper valve 67 is stowed, it can conform to the annular cross-section of the tubular housing 68 and/or the storage cavity 88. This can allow the flapper valve assembly 30 to avoid obstructing or decreasing a flow path area of the casing string to which the flapper valve assembly 30 can be attached. Furthermore, the flapper valve 67 being saddle-shaped can aid in resisting the pressure applied thereon, e.g., from above.

As shown in FIG. 2, the valve seat 120 can also be concave or inversely saddle-shaped, so as to mate with the flapper valve 67 and create a sealing engagement therewith, thereby blocking flow through the inner bore 69. The flapper valve 67 can be made of a frangible material and can be movably fixed to the tubular housing 68 in any suitable manner. The flapper valve 67 can be similar to or the same as the flapper valve described in U.S. Pat. No. 7,708,066 the entirety of which is incorporated by reference herein to the extent it is not inconsistent with this disclosure.

Still referring to FIGS. 1 and 2, the pressurized chamber 71 can be disposed in the upper sub 80. Although not shown, the pressurized chamber 71 can be radially disposed outside of the upper sub 80 or can be located below the flapper valve 67 in the lower sub 72, instead of in the upper sub 80. The pressurized chamber 71 can contain a gas at a reduced pressure in relation to the pressure in the flapper valve assembly 30 below the flapper valve 67. For example, the pressurized chamber 71 can be enclosed or self-contained and can include air at or near surface pressure.

Although not shown, the pressurized chamber 71 can communicate with the surface when deployed down a wellbore such that the surface can be the source of the reduced pressure gas contained in the pressurized chamber 71.

The pressurized chamber 71, no matter its location, can be in communication with a piston chamber 73 via line 75, which can be formed in the upper and central subs 80, 76. For example, the line 75 can extend past the connecting member 79 to provide fluid communication between the pressurized chamber and the piston chamber. The piston chamber 73 can be defined between the lower sub 72 and the piston 90, adjacent a side of the piston 90, as shown. When the sleeve 70 is in the first position, the piston 90 can engage the lower sub 72 such that the piston chamber 73 can have little or no volume. A second chamber 77 can be formed, for example, above the piston 90 and adjacent an opposite side of the piston 90, i.e., across the piston 90 from the piston chamber 73. The second chamber 77 can be separated and/or isolated from the inner bore 69 by the sleeve 70 such that the second chamber 77 can be prevented from communicating with the inner bore 69 and the piston chamber 73. The second chamber 77 can also be held at or about the same pressure as the piston chamber 73 so that there is little or no pressure differential across the piston 90.

The flapper valve assembly 30 can be activated to block a flow of fluid through the inner bore 69. The sleeve 70 can be drawn upward to the second position shown in FIG. 2 from the first position shown in FIG. 1, for example, thereby releasing the flapper valve 67 to the operative state. To draw the sleeve 70 upward, a vented section 110 of the tubular housing 68 can be created after the flapper valve assembly 30 has been positioned at a desired location, for example. The vented section 110 can be created by any suitable perforating operation, including but not limited to: mechanical puncture, sand jetted puncture (i.e., "sand jet perforation"), ballistics such as shaped charges (i.e., "shaped charge perforation"), by hydraulically or otherwise applying pressure to a frangible material such that the frangible material breaks apart, and/or by dissolving a dissolvable material. Any other suitable method of perforating the tubular housing 68 and/or otherwise creating the vented section 110 can also be used. Furthermore, the vented section 110 can extend partially through the tubular housing 68 to the extent necessary to put the pressurized chamber 71 in communication with the inner bore 69. Although not shown, the vented section 110 can extend completely through the tubular housing 68.

The second chamber 77 can be defined between the piston 90 and the upper sub 80 such that, for example, while the sleeve 70 moves toward the second position, the volume of the second chamber 77 can be progressively reduced. In the second position, the sleeve 70 can release the flapper valve 67, allowing the biasing force of the first biasing member 111 and/or the second biasing member 109 to act thereon and urge the flapper valve 67 toward the valve seat 120, for example.

The flapper valve assembly 30 can be activated to release the flapper valve 67 from the stowed position. To activate the flapper valve assembly 30, the tubular housing 68 can be perforated or vented, as described above or by any means known in the art, which can thereby expose the pressurized chamber 71 to the inner bore 69 via the vented section 110. The pressure in the inner bore 69 can be greater than the pressure previously in the pressurized chamber 71. This greater pressure from the inner bore 69 can then be communicated through the vented section 110, through the pressurized chamber 71 and the line 75, to the piston chamber 73, and can thereby increase the pressure in the piston chamber 73. This can create a pressure differential across the piston 90, as the second chamber 77 can remain at the reduced pressure. The pressure differential can draw the piston 90, and therefore the sleeve 70, upward toward the upper sub 80, for example. The second chamber 77 can include any vents as necessary to allow the contents (e.g., air) therein to escape as the piston 90 moves toward the shoulder 96. The contents of the second chamber 77 can escape between the piston 90 and the smooth-walled portion 86. Venting the second chamber 77 can be unnecessary, as the pressure differential between the second chamber 77 and the piston chamber 73 can be sufficiently great to move the piston 90, despite the pressure increases in the second chamber 77 resulting from the volume of the second chamber 77 decreasing.

The drawing of the sleeve 70 upward via a pressure differential across the piston 90 can also be described as releasing the hydrostatic pressure in the inner bore 69. Thus, upon activation, the sleeve 70 can be moved to the second position by simply perforating the tubular housing 68, without requiring mechanical manipulation or engagement of the sleeve 70. For example, the hydrostatic pressure can thus draw the sleeve 70 from the first position (FIG. 1) to the second position (FIG. 2).

While the sleeve 70 slides from the first position to the second position, the flapper valve 67 can be progressively exposed and can eventually be released into the operative state. After entering the operative state, the flapper valve 67 can initially pivot to a closed position, blocking a flow of fluid in a first direction (e.g., downward, as shown), which can isolate portions of the wellbore completion below the flapper valve assembly 30 from portions above it. Furthermore, the flapper valve 67 can pivot to one of a range of open positions, allowing an upward flow of fluid. In this manner, for example, the flapper valve 67 can selectively block fluid flowing therethrough. When selectively blocking fluid flow, for example, the flapper valve 67 can block a first flow of fluid (e.g., the downward flow), and can allow a second flow of fluid (e.g., the upward flow).

Figure 3:
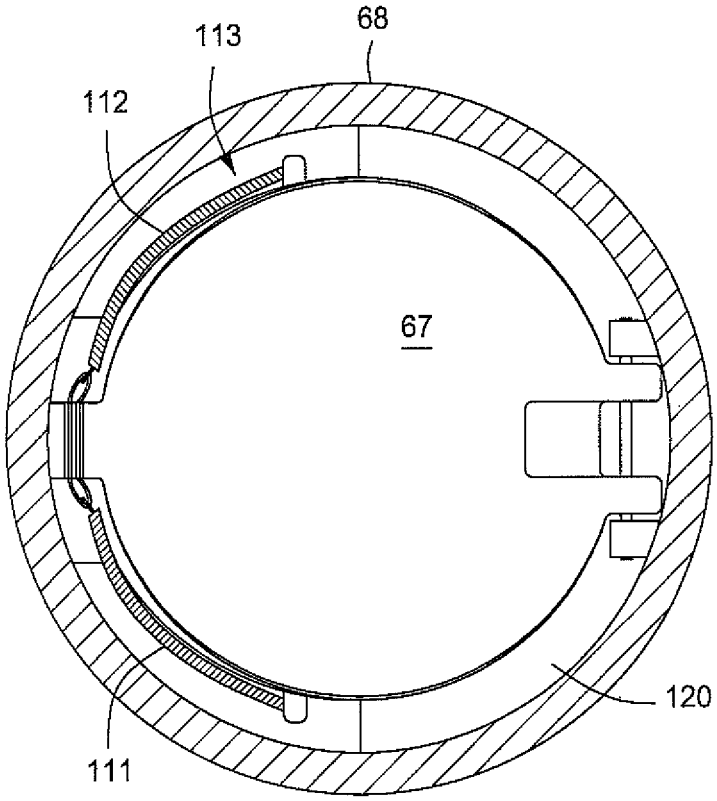
FIG. 3 depicts a cross-sectional view of the flapper valve assembly depicted in FIG. 2 along line 3-3.

FIG. 3 depicts a cross-sectional view of the flapper valve assembly 30 along line 3-3 of FIG. 2, according to one or more embodiments. As shown, the flapper valve assembly 30 can include the first biasing member 111, as described above, and can further include a third biasing member 112. The first and third biasing members 111, 112 can be the same or similar, having approximately equal lengths and spring constants. The first and third biasing members 111, 112 can also be configured differently, having different lengths and/or different spring constants.

The first and third biasing members 111, 112 can reside at least partially in cut-away portions 113 of the valve seat 120 where the outer diameter of the valve seat 120 is reduced to create a cavity to receive the flapper valve 67. As shown, the cut-away portions 113 can be defined where the outside diameter of the valve seat 120 is reduced with respect to the remainder of the valve seat 120. The cut-away portions 113 can provide a space for the biasing members 111, 112 to couple to the valve seat 120 and move freely as the flapper valve 67 pivots. Such cut-away portions 113 can also enable the first and third biasing members 111, 112 to connect with the valve seat 120 without interfering with a seal (not shown) between the flapper valve 67 and the valve seat 120. In another example, the cut-away portions 113 can be an enclosed slots formed in the valve seat 120. The cut-away portions 113 can be formed by any suitable structure such that the first and third biasing members 111, 112 can be coupled to the valve seat 120 and free to pivot or move when the flapper valve 67 pivots, while not interfering with a seal between the flapper valve 67 and the valve seat 120. Although not shown, the cut-away portions 113 can be omitted.

Additionally, the first and third biasing members 111, 112 can connect to the periphery of the flapper valve 67. The first and third biasing members 111, 112 can connect to the flapper valve 67 at the same point, or at least proximal to the same point. For example, the first and third biasing members 111, 112 can connect to the flapper valve 67 proximal the first end 106 of the flapper valve 67, as shown. In another example, however, the first and third biasing members 111, 112 can connect to the periphery of the flapper valve 67 at different points.

Figure 4:
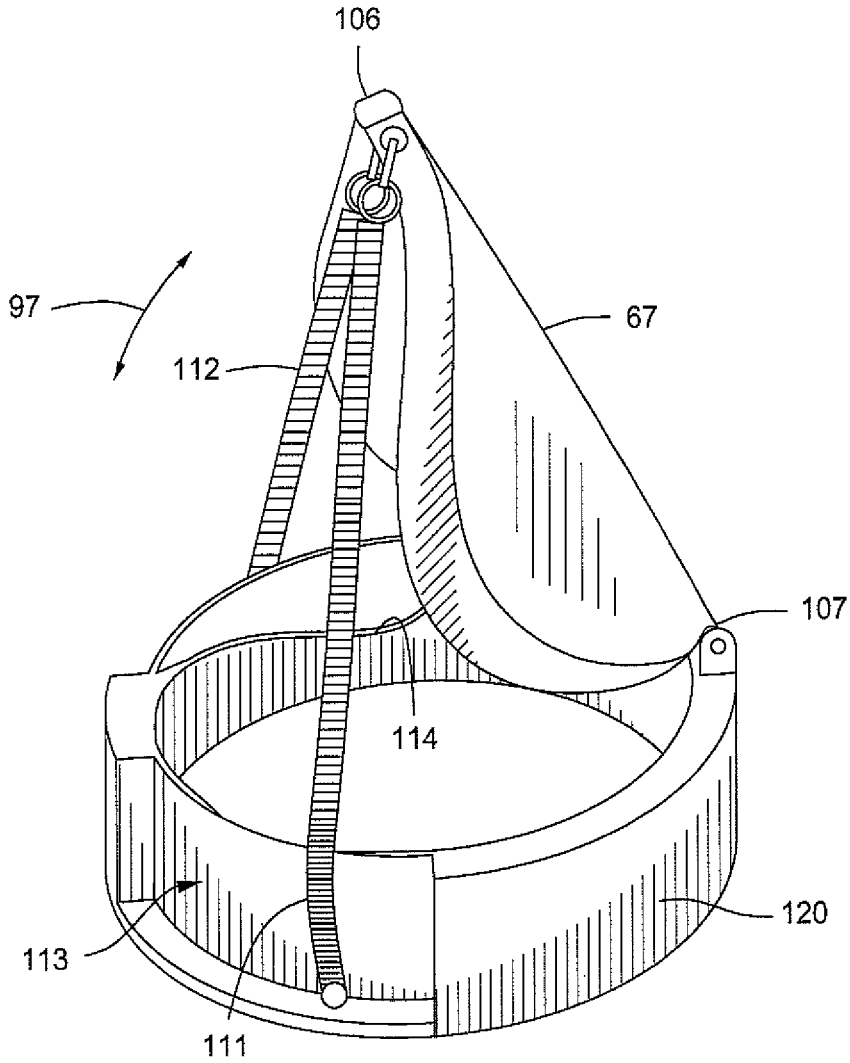
FIG. 4 depicts an isometric view of an illustrative flapper valve having two biasing members, according to one or more embodiments described.

FIG. 4 depicts an isometric view of an illustrative flapper valve 67 in the open position. A first end of each first and third biasing member 111, 112 can be disposed on, coupled to, or otherwise engage the flapper valve 67, and a second end of each biasing member 111, 112 can be disposed on, coupled to, or otherwise engage the valve seat 120. As shown, the second end of each biasing member 111, 112 can be coupled to the valve seat 120 in the cut-away portions 113. As discussed and described above with reference to FIGS. 1 and 2, the valve seat 120 can be part of the tubular housing 68 or disposed therein.

The first and third biasing members 111, 112 can be coupled to the first end 106 of the flapper valve 67, and the second biasing member 109 can be coupled to the second end 107 of the flapper valve 67. The first and third biasing members 111, 112 can also be coupled to the periphery of the flapper valve 67 at one or more locations between the first and second ends 106, 107 of the flapper valve 67. The second biasing member 109 can be coupled to the periphery of the flapper valve 67 at a different location between the first and seconds ends 106, 107 of the flapper valve 67 than the first and third biasing members 111, 112. For example, the first and third biasing members 111, 112 can be coupled to the periphery of the flapper valve 67 from about 90 degrees to about 180 degrees around the flapper valve 67 apart from where the second biasing member 109 is coupled.

Although not shown, the two illustrated biasing members 111, 112 can be one tension spring or one elastomeric band. For example, the ends of the tension spring or elastomeric band can be coupled to the valve seat 120 while the middle of the tension spring or elastomeric band can engage the flapper valve 67 using an eyelet, groove, hook, or any other suitable structure. In another example, one of the first and third biasing members 111, 112 can be omitted.

Referring additionally to FIG. 2, when the sleeve 70 is in the second position, the flapper valve 67 can be located at any of the range of open positions between the valve seat 120 and the tubular housing 68 (e.g., pivoted, shown clockwise, from the valve seat 120 toward the tubular housing 68), as illustrated by arrow 97. Accordingly, the flapper valve assembly 30 can allow a flow of fluid upward through the flapper valve assembly 30. The flapper valve 67 can be in the range of open position when the pressure from below applies a force on the flapper valve 67 greater than the force applied by pressure from above plus the biasing force, for example.

The valve seat 120 can have a lip 114 defined therein to receive the periphery of the flapper valve 67, for example, the bottom thereof. The lip 114 can provide a surface that the flapper valve 67 can be biased toward by the biasing members 109, 111, and/or 112, and compressed against when in the closed position.

Figure 5:
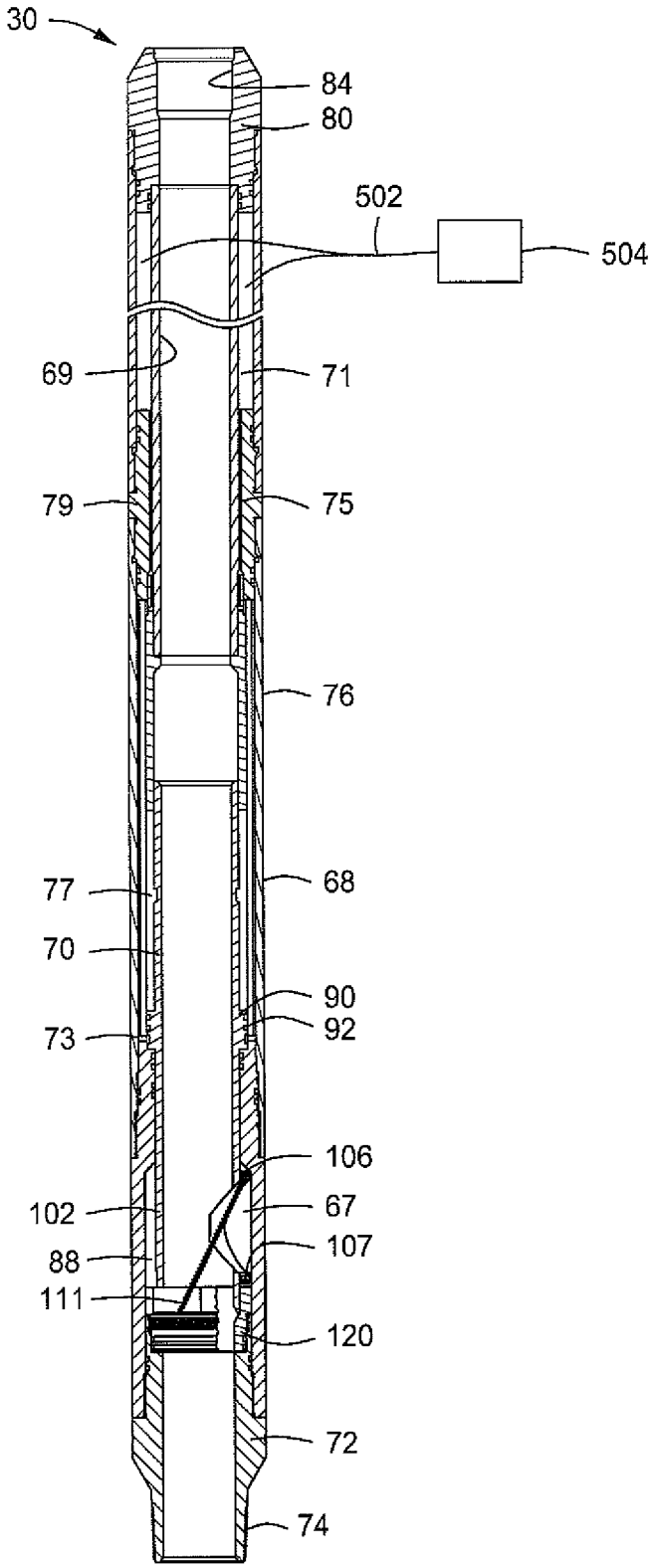
FIG. 5 depicts a cross-sectional view of another illustrative flapper valve assembly, according to one or more embodiments described.

FIG. 5 depicts a cross-sectional view of another illustrative flapper valve assembly 30, according to one or more embodiments. The flapper valve assembly 30 can include one or more lines 502 extending between and operatively connecting a controller 504 and the pressurized chamber 71. The controller 504 can be located at the surface of the wellbore or at another remote location or can be proximal the flapper valve assembly 30. Accordingly, to activate the flapper valve assembly 30, a signal can be sent from the controller 504 through the line 502 and to the second chamber 77 and/or the piston chamber 73. The signal can be pneumatic, hydraulic, or both, such that a higher or lower pressure can be communicated through the line 502 into one of the chambers 73, 77, which can thereby allow one or both of the chambers 73, 77 to act as the above-described pressurized chamber 71 (FIGS. 1 and 2). For example, the controller 504 can include a compressor such that, to move the sleeve 70 from the first to the second position, the controller 504 can send a high pressure flow through the line 502 and into the one of the chambers 73, 77. This can create a pressure differential across the piston 90, thereby causing the sleeve 70 to slide upward, which can thereby release the flapper valve 67.

Furthermore, to re-stow the flapper valve 67, a flow can be evacuated from the piston chamber 73 by the controller 504 via the line 502, for example. This can provide a pressure differential in the reverse direction across the piston 90, which can cause the sleeve 70 to slide back down to stow the flapper valve 67. Although not shown, it will be appreciated that line 502 can include any valves, manifolds, headers, junctions, etc., as needed.

The controller 504 can send an electrical signal to components of the flapper valve assembly 30 to effect movement of the flapper valve 67. For example, the flapper valve assembly 30 can include an electromagnetic solenoid or the like (not shown), which can be actuated to push or pull the sleeve 70 through its movement. Furthermore, the controller 504 can utilize wireless telemetry or wired signals to transmit instructions and can include any receiving devices positioned proximal the flapper valve assembly 30 in the wellbore.

Figure 6:
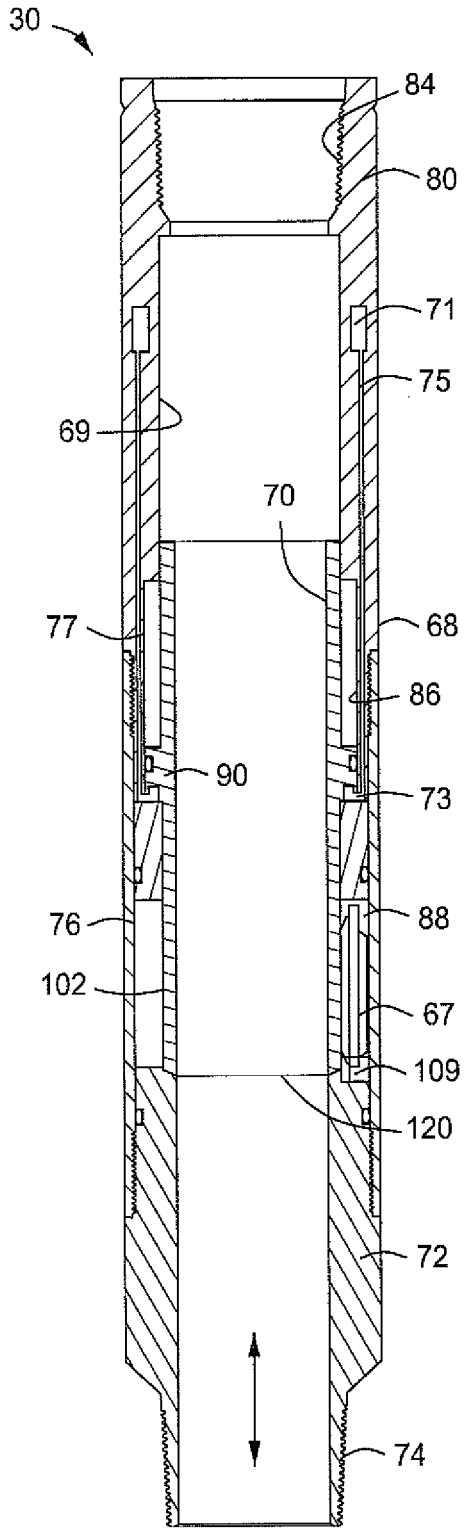
FIG. 6 depicts a cross-sectional view of yet another illustrative flapper valve assembly, according to one or more embodiments described.

FIG. 6 depicts a cross-sectional view of yet another embodiment of the flapper valve assembly 30. The flapper valve assembly 30 can be substantially similar to the flapper valve assembly 30 shown in and described above with reference to FIGS. 1 and 2. Accordingly, the flapper valve assembly 30 can include a flapper valve 67 and a sliding sleeve 70 that can slide from a first to a second position by hydrostatic force applied to the sleeve 70. The flapper valve 67 can have flat extents, as opposed to the saddle-shaped flapper valve 67 described above. The flapper valve 67 can have a flat cross section, or can have a dome shape interior (not shown) to support additional load. The flapper valve 67 can include one or more of the biasing members 109, 111, 112 as described above. For example, the second biasing member 109 can be disposed at one end of the flapper valve 67. Although not shown, in another example the first biasing members 111 and/or third biasing member 112 can be disposed on or coupled to the periphery of the flapper valve 67 and a lower portion of the inner bore 69 or the lower sub 72. The flapper valve 67 can be similar to that described in U.S. Pat. No. 7,287,596, the entirety of which is incorporated herein by reference to the extent it is not inconsistent with this disclosure.

Figure 7:
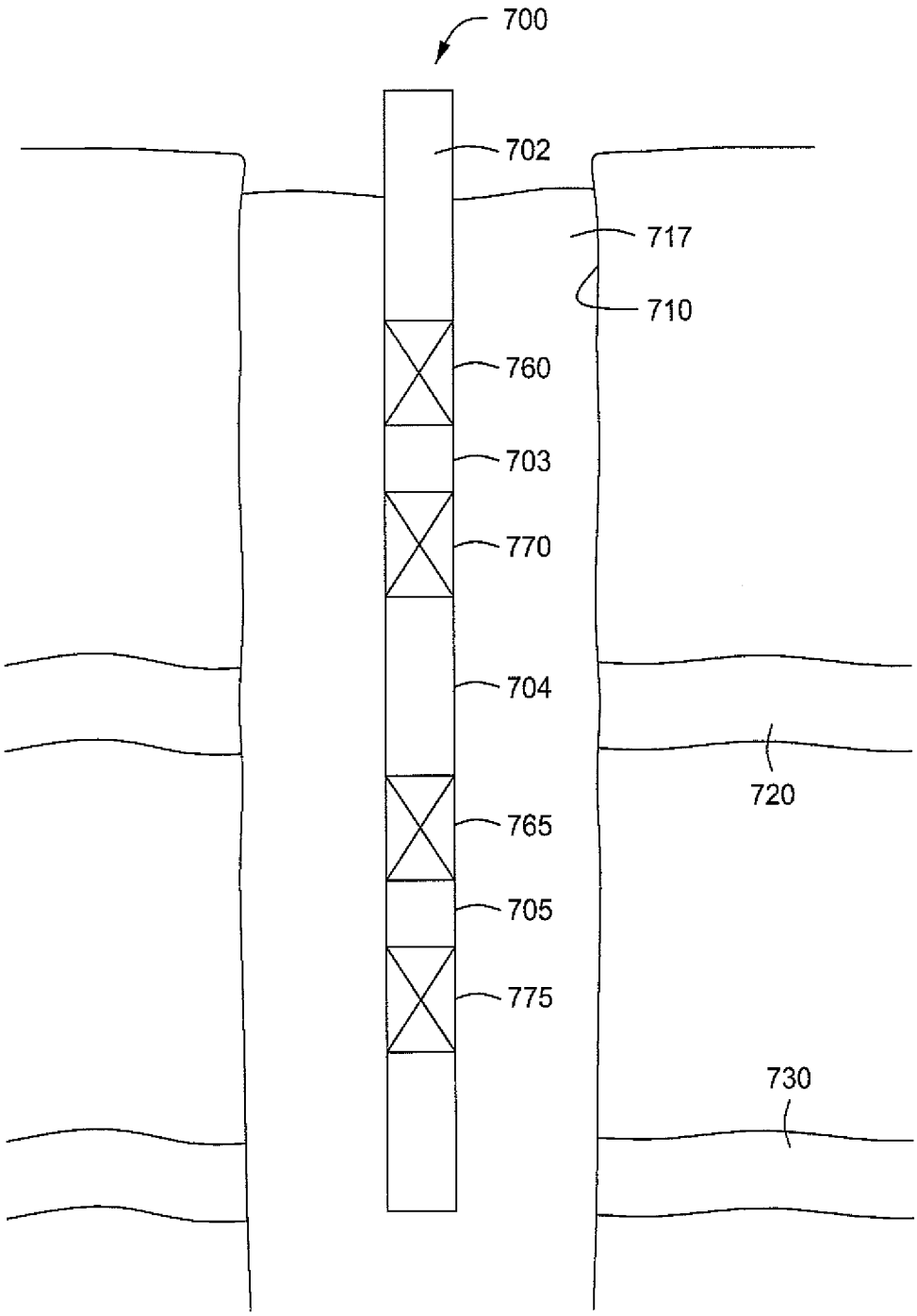
FIG. 7 depicts an illustrative completion for a wellbore including one or more of the illustrative flapper valve assemblies and one or more isolation devices, according to one or more embodiments described.

FIG. 7 depicts an illustrative completion 700 for a wellbore 710, according to one or more embodiments. The completion 700 can have one or more illustrative flapper valve assemblies (two are shown: 760, 765), which can each be or include embodiments of the flapper valve assembly 30 described above, although one or more can be other flapper valve assemblies. The completion 700 can also include one or more isolation devices (two are shown: 770, 775). Although the wellbore 710 is shown as a vertical wellbore, it will be appreciated that the completion 700 is readily adapted for use in a horizontal or deviated wellbore. The completion 700 can be disposed within the wellbore 710 penetrating multiple hydrocarbon-bearing intervals 720, 730.

The flapper valve assemblies 760, 765 and the isolation devices 770, 775 can be disposed on and/or coupled to a tubular or casing string 702 and can enable the independent isolation and testing of individual hydrocarbon-bearing intervals 720, 730 within the wellbore 710. For example, the flapper valve assemblies 760, 765 and the isolation devices 770, 775 can be threaded to the casing string 702. The casing string 702 can include one or more sections (three are shown: 703, 704, 705) that can be one piece with the casing string 702 or that can be separate segments. A cement sheath 717 can be disposed about the casing string 702 to seal the annulus between the casing string 702 and the wellbore 710. The outside diameter of the one or more flapper valve assemblies 760, 765 can be generally equal to the outside diameter of the casing string 702. While running the casing string 702 into the wellbore 710, the flapper valve assemblies 760, 765 can be in a "run-in" position—i.e., in a stowed or completely open position, thereby permitting generally unimpeded bi-directional fluid communication along the length of the completion 700.

As shown, at least one of the isolation devices 770, 775 can be disposed between the flapper valve assemblies 760, 765. It will be appreciated that, although not shown, the completion 700 can include flapper valve assemblies that are not separated by isolation devices. Isolation devices are known in the art and can include, but are not limited to, swellable packers, mechanical set packers, hydraulic set packers, open-hole packers, inflatable packers, cup packers, combinations thereof, and the like.

The flapper valve assemblies 760, 765 can be separated by the first isolation device 770, and the second isolation device 775 can reside below the second flapper valve assembly 765. Accordingly, as shown, the first flapper valve assembly 760 can be located above the first isolation device 770. Further, the first flapper valve assembly 760 and the first isolation device 770 can be coupled together via a first casing string section 703. The first isolation device 770 can be located above the second flapper valve assembly 765, such that the first isolation device 770 is interposed between the first and second flapper valve assemblies 760, 765. The first isolation device 770 and the second flapper valve assembly 765 can be coupled together via a second casing string section 704. The second flapper valve assembly 765 can be located above the second isolation device 775 and coupled therewith via a third casing string section 705.

Additionally, it will be appreciated that the relative positioning of the flapper valve assemblies 760, 765 and isolation valves 770, 775 is merely one example among many contemplated herein. For example, the positions of the first flapper valve assembly 760 and the first isolation device 770 can be reversed, such that both the first and second flapper valve assemblies 760, 765 are located between the first and second isolation valve assemblies 770, 775. Similarly, the positions of the second flapper valve assembly 765 and second isolation device 775 can be reversed such that the first and second flapper valve assemblies 760, 765 are separated by both isolation devices 770, 775.

Moreover, although the flapper valve assemblies 760, 765 and the isolation devices 770, 775 are illustrated as being coupled together via the casing string sections 703, 704, 705, it will be appreciated that, when adjacently positioned, any of the flapper valve assemblies 760, 765 and isolation devices 770, 775 can be directly coupled together such that one or more of the casing string sections 702, 703, 704 can be omitted. Additionally, although not shown, additional isolation devices, flapper valve assemblies, or any other suitable downhole tools known in the art, can be provided and disposed between, above, and/or below the illustrated flapper valve assemblies 760, 765 and/or isolation devices 770, 775. Such additional flapper valve assemblies, isolation devices, and/or other downhole tools can be directly coupled to any of the flapper valve assemblies 760, 765 and/or isolation valve assemblies 770, 775 or can be separated therefrom by one or more sections of casing string 702.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A flapper valve assembly, comprising:

a tubular housing having a storage cavity defined therein and including a valve seat, the tubular housing configured to connect to a wellbore casing;

a sleeve moveable between a first position and a second position, wherein the sleeve in the first position covers the storage cavity and the sleeve in the second position at least partially uncovers the storage cavity;

a flapper valve disposed in the tubular housing, wherein the flapper valve is contained in the storage cavity when the sleeve is in the first position, and wherein the flapper valve is pivotable between an open position and a closed position when the sleeve is in the second position;

a first biasing member engaging the tubular housing and the flapper valve;

a second biasing member coupling the flapper valve to the tubular housing, wherein the first biasing member and the second biasing member are configured to bias the flapper valve toward the valve seat;

wherein the first biasing member is coupled to a periphery of the flapper valve at a first location and the second biasing member is coupled to the periphery of the flapper valve at a second location, wherein the first and second locations are between about 90 and about 180 degrees apart; and a pressurized chamber in fluid communication with the sleeve and adapted to apply a hydrostatic force on the sleeve such that the sleeve moves longitudinally from the first position to the second position.

2. The flapper valve assembly of claim 1, further comprising:

a piston having opposing first and second sides, wherein the piston is coupled to the sleeve and located between the sleeve and the tubular housing;

a piston chamber fluidly communicating with the pressurized chamber and defined in the tubular housing adjacent the first side of the piston; and a second chamber isolated from the pressurized chamber and defined at least partially in the tubular housing adjacent the second side of the piston, wherein a pressure in the second chamber is less than a pressure in the piston chamber when the tubular housing is vented to provide communication between the inner bore and the pressurized housing.

3. The flapper valve assembly of claim 2, wherein the tubular housing is vented by sand jet perforation, shaped charge perforation, or both.

4. The flapper valve assembly of claim 1, wherein the first biasing member, the second biasing member, or both comprise one or more tension springs that are located between the sleeve and the inner bore of the tubular housing when the sleeve is in the first position.

5. The flapper valve assembly of claim 1, wherein the valve seat includes a cut-away portion and the first biasing member, the second biasing member, or both are coupled to the valve seat in the cut-away portion.

6. The flapper valve assembly of claim 1, wherein:

the tubular housing further comprises a vented section extending between the inner bore and the pressurized chamber;

activation includes removing the vented section to provide fluid communication between the inner bore and the pressurized chamber; and the vented section comprises a frangible material, a dissolvable material, or both.

7. The flapper valve assembly of claim 1, wherein:

the tubular housing includes an inner bore;

wherein the inner bore comprises a lower sub coupled to an upper sub, and wherein the valve seat comprises a cylinder coupled to the lower sub and having a bore and a lip defined in the cylinder to receive the flapper valve.

8. The flapper valve assembly of claim 7, wherein the pressurized chamber is housed within the upper sub of the inner bore.

9. The flapper valve assembly of claim 7, wherein:

the sleeve includes a lower end configured to engage the valve seat when the sleeve is in the first position, wherein the sleeve in the first position sealingly covers the storage cavity.

10. The flapper valve assembly of claim 9, wherein the flapper valve is saddle-shaped, such that the flapper valve fits between substantially concentric cylindrical portions of the sleeve and the tubular housing in the storage cavity.

11. A completion for a wellbore, comprising:

a casing string having one or more segments;

one or more isolation devices coupled to one or more of the casing string segments; and one or more flapper valve assemblies coupled to one or more of the casing string segments, wherein each flapper valve assembly comprises:

a tubular housing having an inner bore and a valve seat;

a sleeve disposed in the inner bore and configured to move between a first position and a second position within the tubular housing;

a flapper valve coupled to the tubular housing, wherein the flapper valve is stationary when the sleeve is in the first position, and the flapper valve is pivotable between an open position and a closed position when the sleeve is in the second position;

a first biasing member engaging the tubular housing and the flapper valve;

a second biasing member pivotally coupling the flapper valve to the tubular housing, wherein the first biasing member and the second biasing member are configured to bias the flapper valve toward the valve seat;

wherein the first biasing member is coupled to a periphery of the flapper valve at a first location and the second biasing member is coupled to the periphery of the flapper valve at a second location, wherein the first and second locations are between about 90 and about 180 degrees apart around the periphery of the flapper valve; and a pressurized chamber disposed within the inner bore of the tubular housing in fluid communication with the sleeve, wherein the pressurized chamber is adapted to apply a hydrostatic force on the sleeve upon activation of the downhole tool to move the sleeve from the first position to the second position.

12. The completion of claim 11, wherein:

at least one of the one or more isolation devices is disposed between at least two of the one or more flapper valve assemblies; and each isolation device is a swellable packer, a mechanical set packer, a hydraulic set packer, an open hole packer, a cup packer, or an inflatable packer.

13. The completion of claim 11, wherein:

at least one of the one or more flapper valve assemblies is disposed between two of the one or more isolation devices; and each isolation device is a swellable packer, a mechanical set packer, a hydraulic set packer, an open hole packer, a cup packer, or an inflatable packer.

14. The completion of claim 11, further comprising:

a piston chamber defined in the tubular housing adjacent a first side of a piston, wherein the piston is coupled to the sleeve and slidably engages the tubular housing;

a line extending from the pressurized chamber to the piston chamber, the line configured to provide fluid communication between the pressurized chamber and the piston chamber; and a second chamber defined adjacent a second side of the piston, wherein the piston is configured to move toward the upper sub and reduce a volume of the second chamber when a pressure in the piston chamber is increased.

15. The completion of claim 14, wherein activation of the flapper valve assembly comprises sand jet perforation of the pressurized chamber.

16. The completion of claim 11, wherein:

the tubular housing includes a storage cavity defined therein, wherein the storage cavity is configured to receive the flapper valve; and the sleeve includes a lower end configured to engage the valve seat when the sleeve is in the first position, wherein the sleeve in the first position sealingly covers the storage cavity.

17. A flapper valve assembly, comprising:

a tubular housing having a storage cavity defined therein and including a valve seat, the tubular housing configured to connect to a wellbore casing;

a sleeve moveable between a first position and a second position, wherein the sleeve in the first position covers the storage cavity and the sleeve in the second position at least partially uncovers the storage cavity;

a flapper valve disposed in the tubular housing, wherein the flapper valve is contained in the storage cavity when the sleeve is in the first position, and wherein the flapper valve is pivotable between an open position and a closed position when the sleeve is in the second position;

a first biasing member engaging the tubular housing and the flapper valve;

a second biasing member coupling the flapper valve to the tubular housing, wherein the first biasing member and the second biasing member are configured to bias the flapper valve toward the valve seat; and wherein the first biasing member is coupled to a distal end of the flapper valve and the second biasing member is coupled to a proximal end of the flapper valve, wherein the proximal and distal ends are substantially opposing, and wherein the second biasing member is a pivot pin-and-spring assembly.

18. The flapper valve assembly of claim 17, further comprising:

a pressurized chamber in fluid communication with the sleeve and adapted to apply a hydrostatic force on the sleeve such that the sleeve moves longitudinally from the first position to the second position.

19. The flapper valve assembly of claim 17, further comprising:

a piston having opposing first and second sides, wherein the piston is coupled to the sleeve and located between the sleeve and the tubular housing;

a piston chamber fluidly communicating with the pressurized chamber and defined in the tubular housing adjacent the first side of the piston; and a second chamber isolated from the pressurized chamber and defined at least partially in the tubular housing adjacent the second side of the piston, wherein a pressure in the second chamber is less than a pressure in the piston chamber when the tubular housing is vented to provide communication between the inner bore and the pressurized housing.

20. The flapper valve assembly of claim 19, wherein the tubular housing is vented by sand jet perforation, shaped charge perforation, or both.

* * * * *